US010576346B2

(12) United States Patent
Sakaguchi et al.

(10) Patent No.: US 10,576,346 B2
(45) Date of Patent: Mar. 3, 2020

(54) ARTIFICIAL SHUTTLECOCK FEATHER AND SHUTTLECOCK

(71) Applicant: YONEX KABUSHIKI KAISHA, Tokyo (JP)

(72) Inventors: Takumi Sakaguchi, Tokyo (JP); Shinichiro Chiba, Tokyo (JP)

(73) Assignee: YONEX KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/300,192

(22) PCT Filed: Apr. 27, 2017

(86) PCT No.: PCT/JP2017/016698
§ 371 (c)(1),
(2) Date: Nov. 9, 2018

(87) PCT Pub. No.: WO2017/195618
PCT Pub. Date: Nov. 16, 2017

(65) Prior Publication Data

US 2019/0176007 A1 Jun. 13, 2019

(30) Foreign Application Priority Data

May 9, 2016 (JP) ..... 2016-093663

(51) Int. Cl.

| | |
|---|---|
| ***A63B 67/18*** | (2016.01) |
| ***A63B 67/19*** | (2016.01) |
| ***A63B 67/187*** | (2016.01) |
| *A63B 102/04* | (2015.01) |

(52) U.S. Cl.
CPC ..... *A63B 67/19* (2016.01); *A63B 67/187* (2016.01); *A63B 2102/04* (2015.10); *A63B 2209/00* (2013.01)

(58) Field of Classification Search
CPC ..... A63B 67/18; A63B 67/187; A63B 67/19
USPC ..... 473/579, 580
See application file for complete search history.

(56) References Cited

U.S. PATENT DOCUMENTS

| | | | | | |
|---|---|---|---|---|---|
| 2,485,420 | A * | 10/1949 | Timpe | A63B 67/187 | 473/580 |
| 2,556,029 | A * | 6/1951 | Cohan | A63B 67/187 | 473/580 |
| 2,626,805 | A * | 1/1953 | Carlton | A63B 67/18 | 473/579 |
| 2,632,647 | A * | 3/1953 | Carlton | A63B 67/187 | 473/579 |

(Continued)

FOREIGN PATENT DOCUMENTS

| | | |
|---|---|---|
| EP | 3 228 368 A1 | 10/2017 |
| JP | H10-258144 A | 9/1998 |

(Continued)

*Primary Examiner* — Alexander R Niconovich
(74) *Attorney, Agent, or Firm* — Brinks Gilson & Lione

(57) ABSTRACT

An artificial shuttlecock feather for implanting in a circular ring shape into a base of a shuttlecock, the artificial feather includes: a vane section; and a rachis section supporting the vane section, the rachis section being formed from a material having a Charpy impact strength of 30 kJ/m$^2$ or greater and a flexural modulus of 4 GPa or greater, and preferably having a Charpy impact strength of 36 kJ/m$^2$ or greater and a flexural modulus of 4.7 GPa or greater.

7 Claims, 6 Drawing Sheets

(56) References Cited

U.S. PATENT DOCUMENTS 2,666,643 A * 1/1954 Miller ..... A63B 67/19 473/580
2,734,746 A * 2/1956 Sametz et al. ..... A63B 67/187 473/579
3,313,543 A * 4/1967 Carlton ..... A63B 67/187 473/579
3,752,479 A * 8/1973 Chung ..... A63B 67/18 473/580
3,831,943 A * 8/1974 Popplewell ..... A63B 67/187 473/579
3,891,215 A * 6/1975 Maconachie ..... A63B 67/187 473/579
3,904,205 A * 9/1975 Robinson ..... A63B 67/187 473/579
4,305,589 A * 12/1981 Popplewell ..... A63B 67/193 473/579
4,509,761 A * 4/1985 Liu ..... A63B 67/193 473/579
4,657,262 A * 4/1987 Buckland ..... A63B 67/19 473/580
4,776,596 A * 10/1988 Nojima ..... A63B 43/00 473/165
5,421,587 A * 6/1995 Mao-Huang ..... A63B 67/187 473/579
5,853,340 A * 12/1998 Willis ..... A63B 67/193 473/579
6,709,353 B1 * 3/2004 Peterson ..... A63B 67/18 473/579
6,890,274 B2 * 5/2005 Carlton ..... A63B 67/18 473/579
8,105,185 B2 * 1/2012 Tanaka ..... A63B 67/193 473/579
8,686,082 B2 * 4/2014 Li ..... C08L 51/06 524/445
9,937,399 B1 * 4/2018 Peterson ..... A63B 67/187
2012/0157248 A1 * 6/2012 Dai ..... A63B 67/187 473/580
2013/0210564 A1 * 8/2013 Yoneyama ..... A63B 67/18 473/580
2013/0225339 A1 * 8/2013 Yoneyama ..... A63B 67/18 473/580
2014/0121046 A1 * 5/2014 Dai ..... A63B 67/18 473/580
2014/0155201 A1 * 6/2014 Yoneyama ..... A63B 67/18 473/580
2014/0335980 A1 * 11/2014 Dai ..... A63B 67/18 473/580
2017/0291085 A1 * 10/2017 Chen ..... A63B 67/18
2018/0245280 A1 * 8/2018 Anand ..... F42B 6/06

FOREIGN PATENT DOCUMENTS

JP 2005-126601 A 5/2005
JP 2010-082160 A 4/2010
JP 2012-024157 A 2/2012
JP 2012-075867 A 4/2012
JP 2014-073252 A 4/2014
WO 2012/133520 A1 10/2012

* cited by examiner

| | FLEXURAL MODULUS | CHARPY IMPACT STRENGTH | DENSITY |
|---|---|---|---|
| PHYSICAL PROPERTY | 4.7 GPa OR GREATER | 36 kJ/m² OR GREATER (NOTCHED, BONE DRY, 23° C) | 1.19 g/cm³ OR LESS |

ARTIFICIAL SHUTTLECOCK FEATHER AND SHUTTLECOCK

RELATED APPLICATION

This application is the U.S. National Phase under 35 U.S.C. § 371 of International Application No. PCT/JP2017/016698 A1 filed Apr. 27, 2017, which in turn claims the benefit of Japanese Application No. 2016-093663, filed May 9, 2016, the contents of which are incorporated herein by reference in their entirety.

TECHNICAL FIELD

The present invention relates to an artificial shuttlecock feather and a shuttlecock.

BACKGROUND ART

Badminton shuttlecocks include those that employ feathers (natural feathers) of waterfowl for their feathers (natural feather shuttlecocks), and those that employ artificial feathers synthetically manufactured from a nylon resin or the like therefor (artificial feather shuttlecocks).

As is widely known, natural feather shuttlecocks have a structure using 16 or so natural feathers from a goose, duck, or the like, with a base end of the rachis of each feather implanted into a hemispherical mounting block (base) configured from leather-covered cork or the like. The feathers employed in natural feather shuttlecocks have a low relative density and are extremely light in weight. The rachises of such feathers also have high rigidity. Natural feather shuttlecocks therefore have a distinctive flight performance and a satisfying sensation is obtained when they are hit.

However, the feathers serving as the raw materials for natural feather shuttlecocks are, as mentioned above, harvested from waterfowl. Moreover, they may not be taken from anywhere on the waterfowl, and are taken from sites thereon suitable for shuttlecock use. There are accordingly only a very small number of feathers that can be harvested for shuttlecocks from a single bird, and supply is unstable. There is also a variation in performance thereof.

Although artificial feather shuttlecocks provided with feathers made from resin integrally molded into a ring shape are well known, the feathers are not able to move individually independently of each other in such artificial feather shuttlecocks in the same manner as in natural feather shuttlecocks. This makes it difficult to obtain flight performance similar to that of natural feather shuttlecocks.

There are accordingly proposals for artificial feathers modelled on feathers, as described in Patent Literature 1 below. Namely, there is a proposal for an artificial feather shuttlecock with artificial feathers including a vane section and a rachis section to support the vane section.

CITATION LIST

Patent Literature

Patent Literature 1: JP 2012-24157 A

SUMMARY OF INVENTION

Technical Problem

In artificial feathers such as those described above, generally the weight increases when the rigidity of the rachis section is raised. The weight balance is accordingly worse for artificial feather shuttlecocks and the flight performance thereof deteriorates. However, reducing the weight of the rachis section lowers the rigidity thereof. This leads to a slower recovery when hit, and to a deterioration in flight performance. In order to raise the flight performance, preferably a distal end side of the rachis section is made thinner and lighter in weight, and the rigidity of a base end side of the rachis section is preferably raised. However, such an approach leads to a deterioration in the impact resistance ability of the rachis section (in particular at the distal end side thereof), and to the possibility of damage to the rachis section.

In consideration of the above issues, an object of the invention is to improve flight performance while suppressing damage from occurring.

Solution to Problem

A main aspect for achieving the object is an artificial shuttlecock feather for implanting in a circular ring shape into a base of a shuttlecock, the artificial feather including: a vane section; and a rachis section supporting the vane section, the rachis section being formed from a material having a Charpy impact strength of 30 kJ/m$^2$ or greater and a flexural modulus of 4 GPa or greater, and preferably having a Charpy impact strength of 36 kJ/m$^2$ or greater and a flexural modulus of 4.7 GPa or greater.

Other features of this invention will become clear from descriptions of this specification and drawings.

Advantageous Effects of Invention

The artificial shuttlecock feather of the invention is capable of improving flight performance while also being able to suppress damage from occurring.

DESCRIPTION OF EMBODIMENTS

Overview

Figure 1:
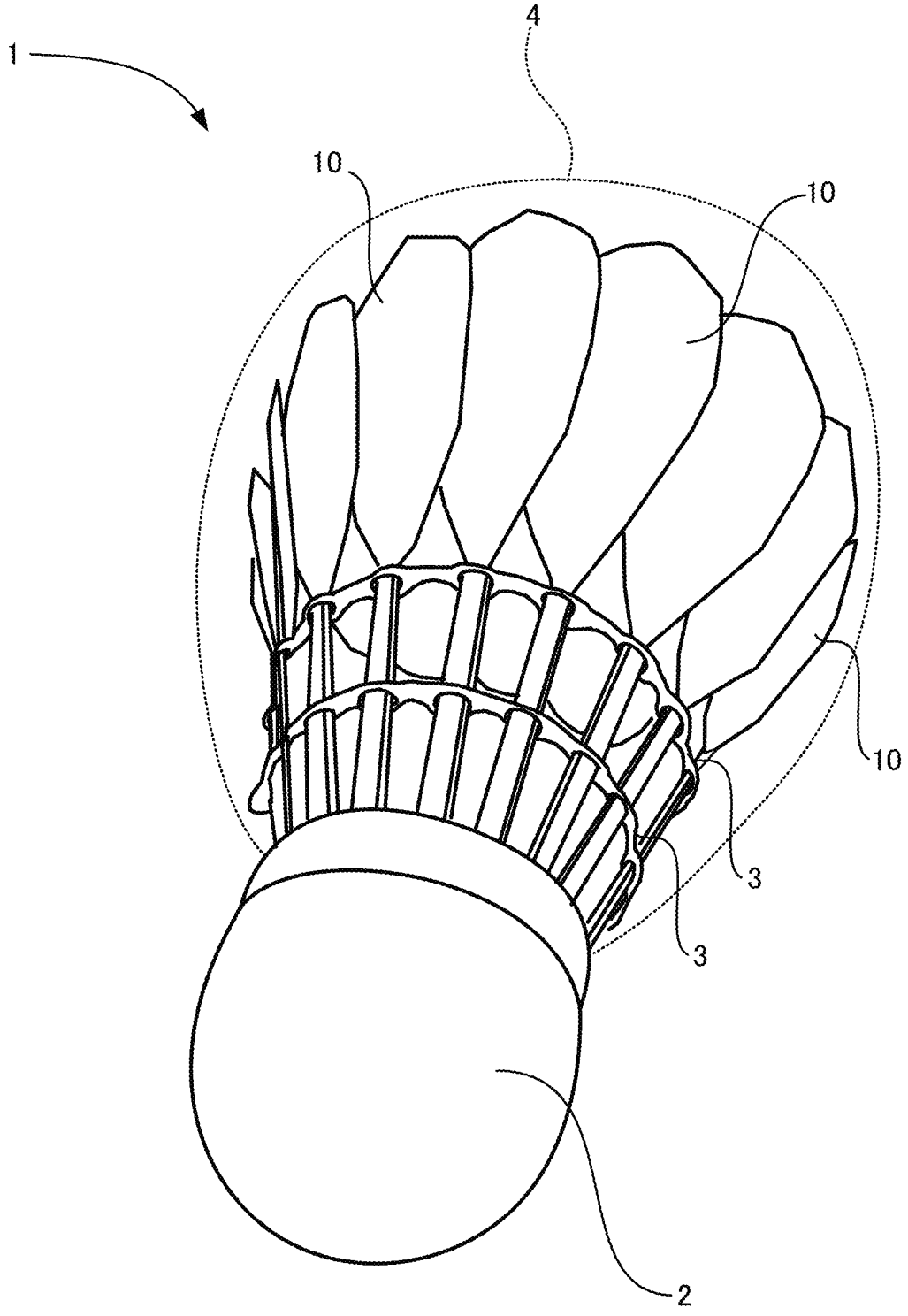
FIG. 1 is a perspective view illustrating an artificial feather shuttlecock, as viewed from a base side.

At least the below matters will become clear from descriptions of this specification and drawings.

An artificial shuttlecock feather for implanting in a circular ring shape into a base of a shuttlecock will become clear, the artificial feather including: a vane section; and a rachis section supporting the vane section, the rachis section being formed from a material having a Charpy impact strength of 30 kJ/m$^2$ or greater and a flexural modulus of 4

GPa or greater, and preferably having a Charpy impact strength of 36 kJ/$m^2$ or greater and a flexural modulus of 4.7 GPa or greater.

Such an artificial shuttlecock feather is capable of achieving improved flight performance and is also able to suppress damage from occurring.

According to the artificial shuttlecock feather, wherein preferably a density of the material is 1.21 g/cm3 or less, and is preferably 1.19 g/cm3 or less.

Such an artificial shuttlecock feather is capable of further improving flight performance.

According to the artificial shuttlecock feather, wherein preferably: the vane section is provided to a distal end side of the rachis section; and a length ratio W/H in a first position in a location where the vane section is not disposed differs from the length ratio W/H in a second position in a location where the vane section is disposed, wherein a width direction is a direction orthogonal to both an axial direction of the rachis section and a direction normal to the vane section, H is a maximum length in the normal direction in a given position on the rachis section, and W is a maximum length in the width direction in the given position on the rachis section.

Such an artificial shuttlecock feather enables changes to the rigidity and weight between a distal end side and base end side (base side) of the rachis.

According to the artificial shuttlecock feather, wherein preferably the length ratio W/H in the first position is greater than the length ratio W/H in the second position.

Such an artificial shuttlecock feather is capable of raising rigidity in the base end side while also being capable of achieving a reduction in weight in the distal end side.

According to the artificial shuttlecock feather, wherein preferably a line of maximum length connecting two ends in the normal direction length intersects with a line of maximum length connecting two ends in the width direction at an intersection further outside the circular ring shape than a center of the rachis section in the normal direction.

Such an artificial shuttlecock feather is capable of achieving an improvement in impact resistance ability.

According to the artificial shuttlecock feather, wherein preferably a jutting-out portion is formed projecting in the width direction in a location of the rachis section where the vane section is not disposed.

Such an artificial shuttlecock feather is capable of increasing strength against twisting.

According to the artificial shuttlecock feather, wherein preferably an inclined face is formed between an end of the jutting-out portion in the width direction and an apex of the rachis section outside the circular ring shape in the normal direction.

Such an artificial shuttlecock feather stabilizes flight performance.

A shuttlecock employing the above artificial shuttlecock feather is also made clear.

===Embodiments===

<Basic Structure of Artificial Feather Shuttlecock>

Figure 2:
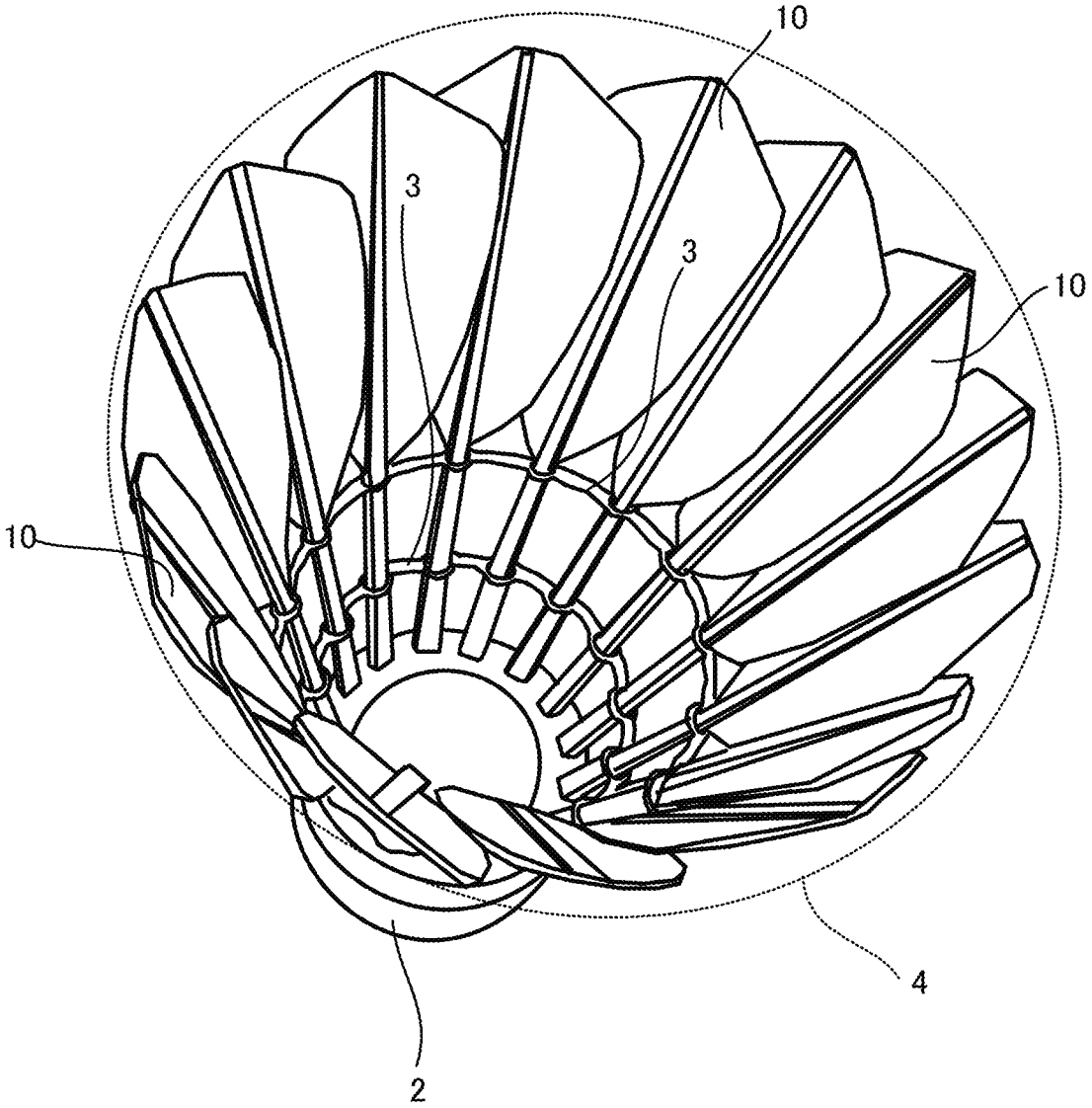
FIG. 2 is a perspective view illustrating an artificial feather shuttlecock, as viewed from an artificial feather side.

FIG. 1 and FIG. 2 are external views to explain the basic structure of an artificial feather shuttlecock 1 provided with artificial feathers 10. FIG. 1 is a perspective view illustrating the artificial feather shuttlecock 1, as viewed from a base 2 side. FIG. 2 is a perspective view illustrating the artificial feather shuttlecock 1, as viewed from the artificial feather 10 side.

The artificial feather shuttlecock 1 includes a base 2, plural of the artificial feathers 10 modelled on natural feathers, and cord shaped members 3 for fixing the artificial feathers 10 together. The base 2 is configured by, for example, covering a cork mounting block with thin leather. The shape of the base 2 is a hemispherical shape having a diameter of from 25 mm to 28 mm and including a flat face. Basal portions (base ends) of the plural (specifically 16) artificial feathers 10 are embedded in a circular ring shape around the circumference of the flat face. The plural artificial feathers 10 are arranged such that separations therebetween widen on progression away from the base 2. As illustrated in the drawings, each of the artificial feathers 10 is arranged so as to overlap with the respective adjacent artificial feathers 10. A skirt section 4 is thereby formed with the plural artificial feathers 10. The plural artificial feathers 10 are fixed together with the cord shaped members 3 (for example cotton threads).

<Artificial Feather Structure>

Figure 3:
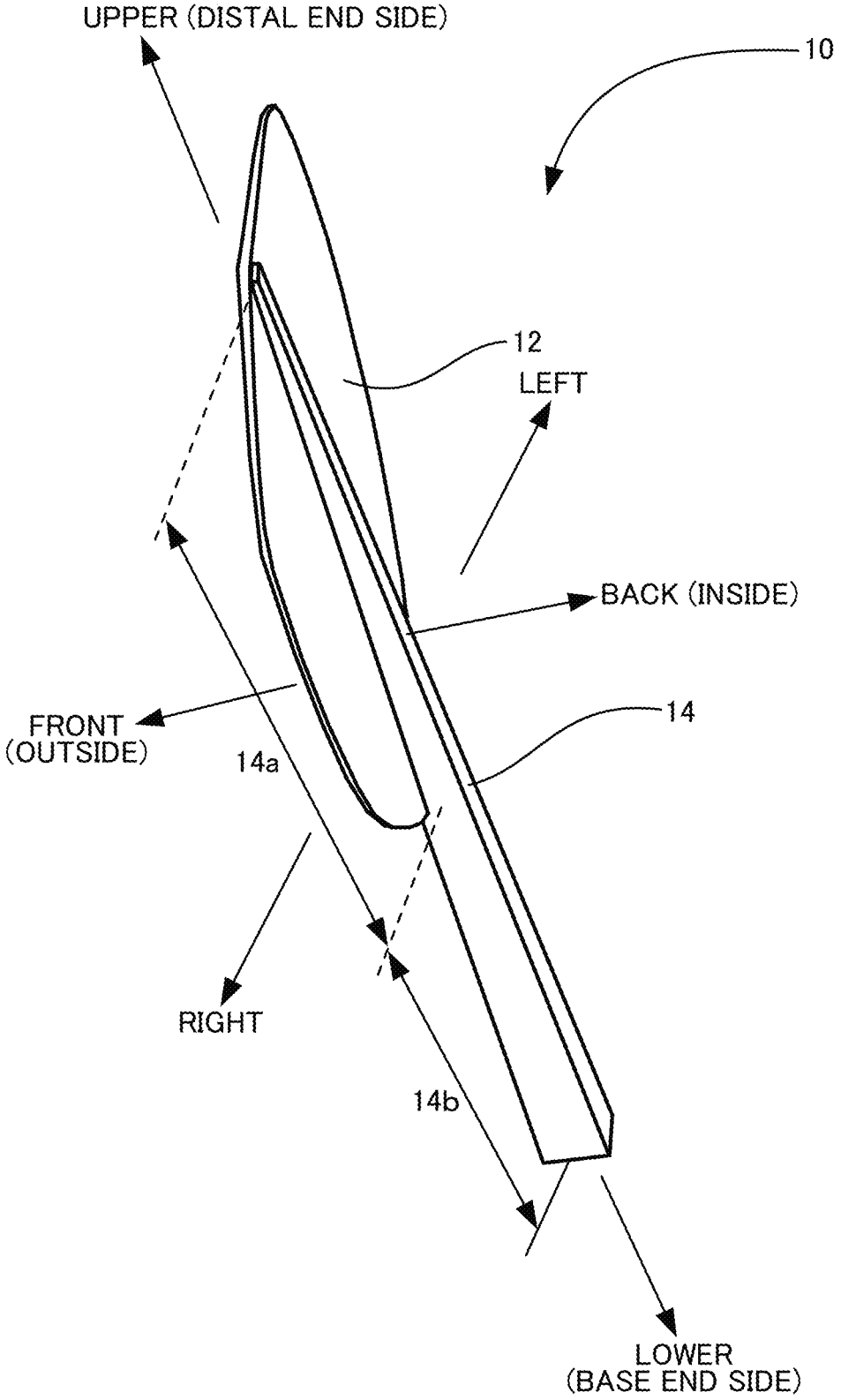
FIG. 3 is an external view of an artificial feather.

FIG. 3 is an external view of an artificial feather 10. The same reference signs are appended in the drawings to members that have already been described.

Each of the artificial feathers 10 includes a vane section 12 and a rachis section 14. The vane section 12 is a portion corresponding to vanes of a natural feather, and the rachis section 14 is a portion corresponding to the rachis of a natural feather. In the drawings there is a defined top-to-bottom direction (corresponding to an axial direction) running along the length of the rachis section 14, with the side of the vane section 12 being an upper (distal end side), and the opposite side thereto being a lower (base end side). In the drawings there is also a defined left-to-right direction (corresponding to a width direction) which runs along the direction of extension of the vane section 12 from the rachis section 14. Front and back in the drawings are defined according to the attached state of the artificial feathers 10 to the base 2. Note that a front-to-back direction corresponds to a direction normal to the vane section 12. In a state in which the artificial feathers 10 are arranged in a circular ring shape on the base 2, the front corresponds to the outside and the back corresponds to the inside. Each of the respective configuration elements will now be described using upper/lower, left/right, and front/back as defined in the drawings.

The vane section 12 is a member modelled on the shape of vanes of a natural feather. The vane section 12 may, for example, be configured by a nonwoven cloth, a resin, or the like. In cases in which a nonwoven cloth is employed, a reinforcement covering layer is formed on a front face thereof in order to prevent fibers of the nonwoven cloth from fraying when hit. The reinforcement covering layer may be formed by applying a resin coating. Various coating methods may be employed therefor, such as a dipping method, a spraying method, or a roll-coating method, for example. The reinforcement covering layer may be formed to a single face of the vane section 12, or may be formed to both faces thereof. The reinforcement covering layer may be formed over the entire surface of the vane section 12, or may be formed to part of the vane section 12. The shape of the vane section 12 is not limited to the shape illustrated in the drawings. An elliptical shape may, for example, be adopted therefor.

The rachis section 14 is a long and thin member modelled on the shape of the rachis of a natural feather, and is a member supporting the van section 12. The rachis section 14 includes a vane support portion 14*a* to support the vane section 12, and a calamus portion 14*b* projecting from the vane section 12. The calamus portion 14*b* is a portion corresponding to the calamus (this location is also referred to as the quill) of a natural feather. A base end of the rachis section 14 (lower end of the calamus portion 14*b*) is embedded in the base 2 so as to be fixed to the base 2. The distal end of the rachis section 14 (upper end of the vane support portion 14*a*) is aligned with an upper end of the vane section 12.

The rachis section 14 and the vane section 12 may be configured by separate bodies, or may be configured by a single body. For example, when a resin is employed as the material for the rachis section 14 and the vane section 12, the rachis section 14 and the vane section 12 may be molded as a single body by injection molding using a mold. The rachis section 14 and the vane section 12 may also be formed as a single body with different materials for each by injection molding (two-color molding) employing two types of material (resin).

The vane section 12 may be supported in the front side of the vane support portion 14*a*, and the vane section 12 may be supported on the back side of the vane support portion 14*a*. The vane section 12 may also be configured by two sheets, configured such that the vane support portion 14*a* is sandwiched between the two sheet vane section 12. The vane section 12 may also be embedded within the vane support portion 14*a*.

Although in the present example a square cross-section profile is employed irrespective of the position on the rachis section 14, improved profiles are achieved in embodiments described later.

<Flight Performance>

The feathers employed in natural feather shuttlecocks have a low relative density and are extremely light in weight. The rachises of these feathers also have high rigidity, and return to their original shape irrespective of the cumulative number of times they have been hit. Natural feather shuttlecocks therefore obtain a distinctive flight performance of a high initial speed that is then braked.

If the rigidity of the rachis section 14 were to be raised in the artificial feather shuttlecock 1 employing the artificial feathers 10 then this would lead to an increase in weight and a worse weight balance. This would make the flight performance such as that of a natural feather shuttlecock unobtainable. If, however, the weight of the rachis section 14 were to be reduced and the rigidity lowered, then this would result in slower recovery when hit. The flight performance would accordingly deteriorate.

In order to achieve flight performance close to that of a natural feather shuttlecock, the weight of the distal end side of the rachis section 14 (the vane support portion 14*a*) should be reduced and the rigidity of the base end side (the calamus portion 14*b*) should be increased. Specifically, for an artificial feather shuttlecock 1 including 16 of the artificial feathers 10, the vane support portion 14*a* preferably weighs 0.03 g or less and has a rigidity of 0.2 N or greater, and the calamus portion 14*b* preferably has a rigidity of 1.1 N or greater and weighs 0.08 g or less. Note that rigidity here is the measured value of a force when one end of a sample is fixed to a fixing jig and force is applied to the other end side so as to displace the other end by 10 mm. At or above these weights, the position of the center of gravity approaches a distal end side (upper side) and flight performance deteriorates. At or below these rigidities, recovery when hit becomes slower and flight performance also deteriorates.

However, forming the rachis section 14 to the above conditions might lead to a lower impact resistance ability, particularly in the distal end side, with a possibility of the rachis section 14 being damaged when hit.

The present embodiment is accordingly designed to improve flight performance while also suppressing damage from occurring due to being hit.

<Improved Example of Artificial Feather (Present Embodiment)>

Figure 4:
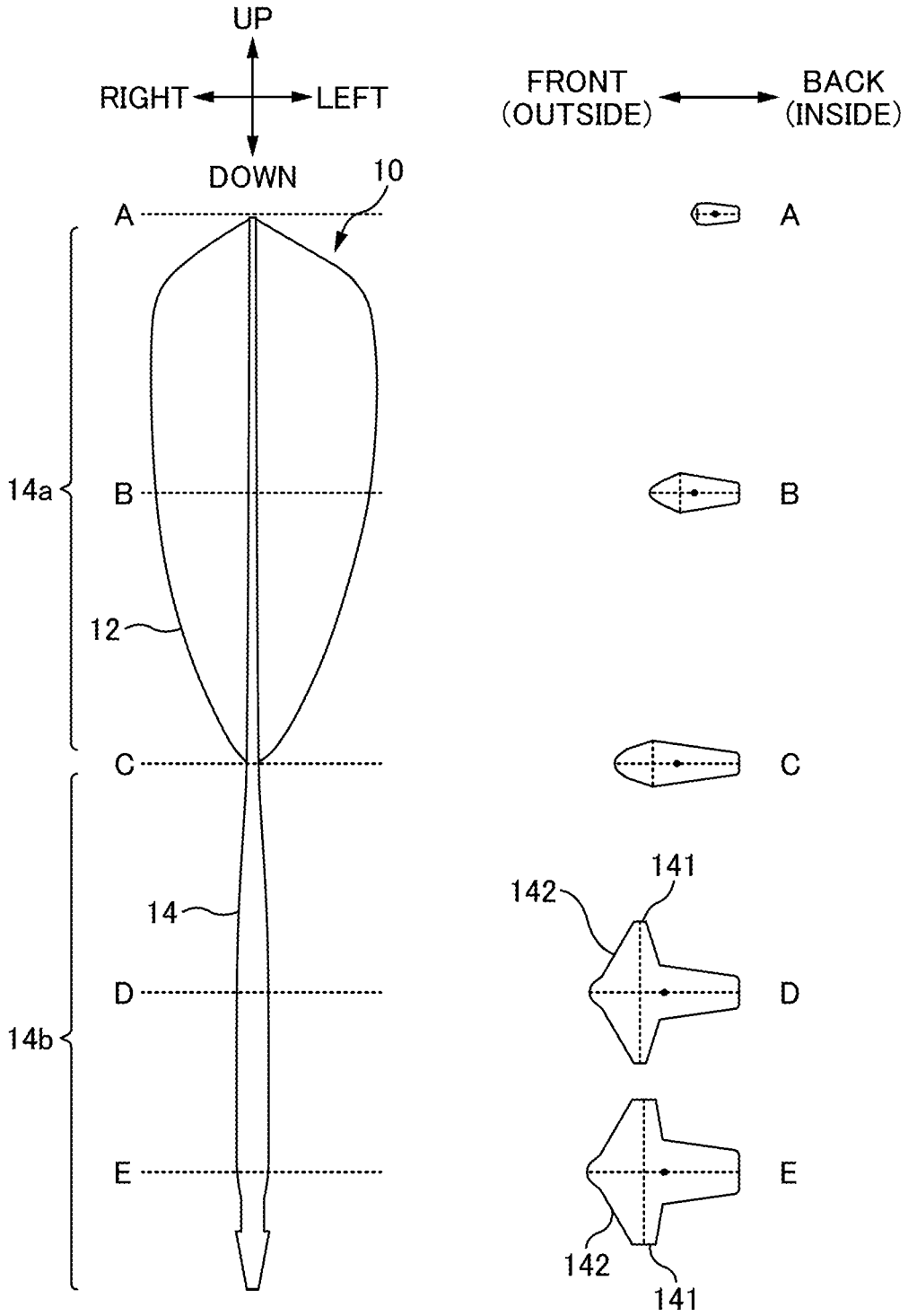
FIG. 4 is a diagram illustrating a configuration of an improved example (present embodiment) of an artificial feather.

FIG. 4 illustrates a configuration of an improved example (present embodiment) of an artificial feather 10. An external view of the artificial feather 10, as viewed from the back side, is illustrated in the left side portion of FIG. 4, and cross-sections at respective positions A to E of the rachis section 14 are illustrated in the right side portion of FIG. 4. The configuration of the rachis section 14 in the present embodiment differs from that illustrated in FIG. 3. The vane section 12, however, is the same as that illustrated in FIG. 3, and so description thereof will be omitted.

The rachis section 14 of the present embodiment has a different cross-section profile at the vane support portion 14*a* (A to C in FIG. 4) from that at the calamus portion 14*b* (C to E in FIG. 4). The vane support portion 14*a* corresponds to locations of the rachis section 14 where the vane section 12 is disposed, and the calamus portion 14*b* corresponds to locations thereof where the vane section 12 is not disposed.

A jutting-out portion 141 projecting in a width direction is formed to the calamus portion 14*b* in the present embodiment. The jutting-out portion 141 is provided so as to project toward both sides in the left-to-right direction (width direction) further to the front side (outside of the circular ring shape) than a center of the rachis section 14 in the front-to-back direction. Due to the jutting-out portion 141 being formed to the calamus portion 14*b*, a length ratio W/H differs between in the calamus portion 14*b* and in the vane support portion 14*a*, wherein H is a maximum front-to-back direction (normal direction) length at a given position on the rachis section 14 and W is a maximum left-to-right direction (width direction) length thereat. More specifically, the length ratio W/H at each position on the calamus portion 14*b* is greater than the length ratio W/H at each position on the vane support portion 14*a*. For example, the length ratio W/H is 0.95 at the position D in FIG. 4, whereas the length ratio W/H is 0.44 at the position B.

The calamus portion 14*b* is stronger at resisting twisting due to the jutting-out portion 141 being provided on the calamus portion 14*b* in this manner. Although there is no jutting-out portion 141 provided on the vane support portion 14*a*, this does not result in the vane support portion 14*a* being vulnerable to twisting due to the presence of the vane section 12. A reduction in weight can be achieved by not providing the jutting-out portion 141 to the vane support portion 14*a* in this manner.

In the artificial feather 10 of the present embodiment, an average W/H change ratio between the position C and the position E on the calamus portion 14*b* side is greater than the average W/H change ratio between the position A and the position C on the vane support portion 14*a* side (average W/H change ratio between C and E average W/H change ratio between A and C). The average W/H change ratio referred to here is a value obtained by dividing a difference between the maximum value and minimum value of the length ratio W/H in a target range by the length of this range. Due to a portion further toward the lower side (base end side) than the position E being embedded in the base 2, on the calamus portion 14*b* side between the position C and the position. E (between C and E) is taken as the target range.

In each of the cross-sections, a line of maximum length connecting two ends in the front-to-back direction and a line of maximum length connecting two ends in the left-to-right direction are illustrated by dashed lines. The center position of the rachis section 14 in the front-to-back direction is illustrated by a black dot. In the rachis section 14 of the present embodiment, the line of maximum length connecting two ends in the front-to-back direction and the line of maximum length connecting along the left-to-right direction intersect with each other further to the outside (front side) than the front-to-back direction center, irrespective of the position (axial direction position). This thereby enables an improvement in the impact resistance ability to be achieved.

Inclined faces 142 are formed between ends of the jutting-out portion 141 and an apex on the front side of the rachis section 14. These provide extra strength to resist twisting, and also stabilize flight performance due to being excellent aerodynamically by not disturbing airflow.

The rachis section 14 of the present embodiment thereby achieves a reduction in weight on the vane support portion 14*a* side, and achieves improved rigidity on the calamus portion 14*b* side.

Investigations were performed with the configuration illustrated in FIG. 4 into properties of materials that satisfy the weight and rigidity conditions described above, and are also not damaged when hit.

Figures 5, 6:
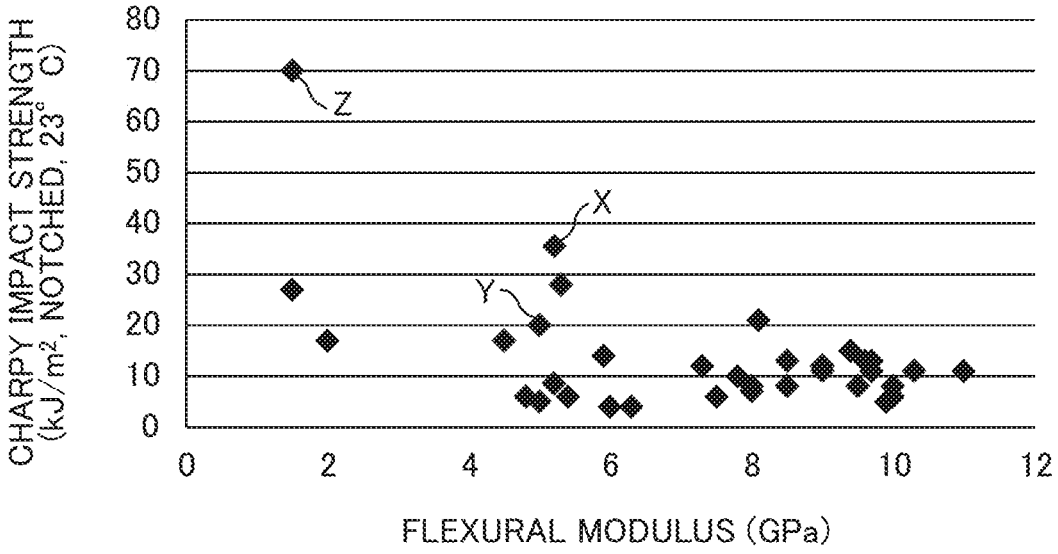
FIG. 5 is a graph illustrating a relationship between Charpy impact strength and flexural modulus for glass-reinforced nylon.
FIG. 6 is a table of physical properties required in a rachis section 14 of the present embodiment.

FIG. 5 is a graph illustrating a relationship between Charpy impact strength and flexural modulus in glass-reinforced nylon. The elastic modulus (GPa) is shown on the horizontal axis in the graph, and the Charpy impact strength (kJ/m2) is shown on the vertical axis. FIG. 6 is a table of physical properties required in the rachis section 14 of the present embodiment. The Charpy impact strength is a value measured by performing Charpy impact testing (notch testing) according to ISO179 at 23° C. in a 50% humidity atmosphere.

Employing a material having a Charpy impact strength of 36 kJ/m$^2$ and a flexural modulus of 4.7 GPa (the material labeled X in FIG. 5) as the material of the rachis section 14 of the present embodiment enables stable flight performance to be obtained, and damage did not occur even when hit repeatedly. The density of this material is 1.19 g/cm$^3$. This confirmed that good characteristics can be obtained when the Charpy impact strength is 36 kJ/m$^2$ or greater, the flexural modulus is 4.7 GPa or greater, and the density is 1.19 g/cm$^3$ or less. However, since there is some variation in material characteristics between lots, conditions for these properties considering such variation are a Charpy impact strength of 30 kJ/m$^2$ or greater, a flexural modulus of 4 GPa or greater, and a density of 1.21 g/cm$^3$ or less.

On the other hand, the rachis section 14 of materials having a lower Charpy impact strength than the above (for example the material labeled Y in FIG. 5) was damaged when hit repeatedly. Moreover, recovery when hit was slower and flight performance was poorer for materials having a low bending elastic moduli (for example the material labeled Z in FIG. 5), even at high Charpy impact strengths.

In light of these results, a material having a Charpy impact strength of 30 kJ/m$^2$ or greater, a flexural modulus of 4 GPa or greater, and a density of 1.21 g/cm$^3$ or less (and preferably having a Charpy impact strength of 36 kJ/m$^2$ or greater, a flexural modulus of 4.7 GPa or greater, and a density of 1.19 g/cm$^3$ or less) is employed as the material of the rachis section 14 of the present embodiment. This thereby enables an improvement in flight performance to be achieved, as well as enabling damage to the rachis section to be suppressed from occurring. A glass-reinforced nylon/polyolefin alloyed resin is employed in the present embodiment as the material of the rachis section 14. However, there is no limitation thereto and any material that satisfies the above physical properties may be employed therefor.

As described above, the rachis section 14 of the present embodiment achieves a reduction in weight on the vane support portion 14*a* side and achieves improved rigidity on the calamus portion 14*b* side, and the material employed therefor has a Charpy impact strength of 30 kJ/m$^2$ or greater and a flexural modulus of 4 GPa or greater. This thereby enables improved flight performance to be achieved, as well as enabling damage to the rachis section 14 from hitting to be suppressed.

<Modified Example>

Figure 7:
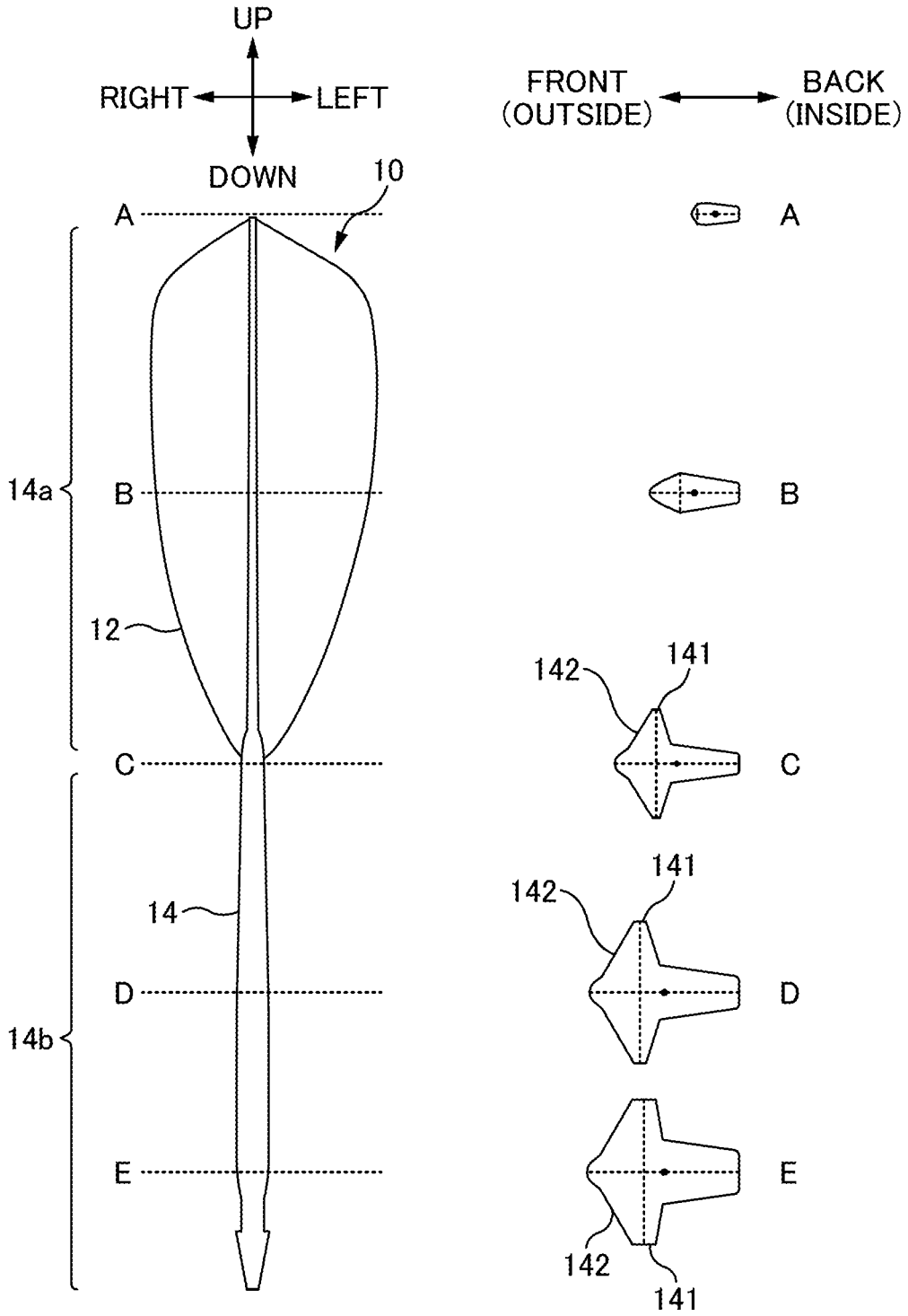
FIG. 7 is an explanatory diagram of a modified example of an artificial feather of the present embodiment.

FIG. 7 is an explanatory diagram illustrating a modified example of the artificial feather 10 of the present embodiment. Similarly to in FIG. 4, an external view of an artificial feather 10, as viewed from the back side, is illustrated on a left side portion of FIG. 7, and cross-sections at respective positions A to E of the rachis section 14 are illustrated on a right side portion of FIG. 7. The same reference signs are appended in FIG. 7 to portions the same as those of FIG. 4, and description thereof is omitted.

In the modified example too, the length ratio W/H at each position on a calamus portion 14*b* is greater than the length ratio W/H at each position on a vane support portion 14*a*.

However, although in the above embodiment (FIG. 4), the jutting-out portion 141 is only formed to the calamus portion 14*b*, in the modified example the jutting-out portion 141 is also formed at the position C and at a portion (end portion) on the base end side of the vane support portion 14*a*. In the modified example there is therefore a large change in the length ratio W/H on the vane support portion 14*a* side. Namely, although in the above embodiment the average W/H change ratio between C and E>average W/H change ratio between A and C, in contrast thereto, the average W/H change ratio in the modified example between C and E<average W/H change ratio between A and C.

The modified example enables even better performance to be obtained.

Other Points

The above embodiment modes are to facilitate understanding of this invention, and are not for limiting this invention in any way. It is needless to say that this invention can be changed or modified without deviating from the scope, and this invention includes its equivalents.

Although the vane section 12 is sheet shaped in the above embodiment, there is no limitation thereto. For example, a three dimensional (3D) shape may be adopted therefor.

REFERENCE SIGNS LIST

1 artificial feather shuttlecock,
2 base,
3 cord shaped member,
4 skirt section,
10 artificial feather,
12 vane section,
14 rachis section,
14*a* vane support portion,
14*b* calamus portion,
141 jutting-out portion,
142 inclined face

The invention claimed is:

1. An artificial shuttlecock feather that is to be implanted in a circular ring shape into a base of a shuttlecock, the artificial feather comprising:

a vane section; and a rachis section supporting the vane section, the rachis section being formed from a material having a Charpy impact strength of 30 $kJ/m^2$ or greater and a flexural modulus of 4 GPa or greater, wherein the vane section is provided to a distal end side of the rachis section; and a length ratio W/H in a first position in a location where the vane section is not disposed differs from the length ratio W/H in a second position in a location where the vane section is disposed, wherein, a width direction is a direction orthogonal to both an axial direction of the rachis section and a direction normal to the vane section, H is a maximum length in the normal direction in a given position on the rachis section, and W is a maximum length in the width direction in the given position on the rachis section, an average W/H change ratio in a location where the vane section is not disposed is smaller than an average W/H change ratio in a location where the vane section is disposed.

2. The artificial shuttlecock feather according to claim 1, wherein a density of the material is 1.21 $g/cm^3$ or less.

3. The artificial shuttlecock feather according to claim 1, wherein the length ratio W/H in the first position is greater than the length ratio W/H in the second position.

4. The artificial shuttlecock feather according to claim 1, wherein a line of maximum length connecting two ends in the normal direction length intersects with a line of maximum length connecting two ends in the width direction at an intersection further outside the circular ring shape than a center of the rachis section in the normal direction.

5. The artificial shuttlecock feather according to claim 1, wherein a jutting-out portion is formed projecting in the width direction in a location of the rachis section where the vane section is not disposed.

6. The artificial shuttlecock feather according to claim 5, wherein an inclined face is formed between an end of the jutting-out portion in the width direction and an apex of the rachis section outside the circular ring shape in the normal direction.

7. A shuttlecock employing the artificial shuttlecock feather according to claim 1.

* * * * *